US011457724B2

(12) United States Patent
Kumpf et al.

(10) Patent No.: US 11,457,724 B2
(45) Date of Patent: Oct. 4, 2022

(54) METHOD AND DEVICE FOR MACHINING SCREWED-IN BRUSHES

(71) Applicant: Zahoransky AG, Todtnau (DE)

(72) Inventors: Ingo Kumpf, Todtnau (DE); Marc Konig, Freiburg (DE); Florian Kiefer, Frohnd (DE)

(73) Assignee: Zahoransky AG, Todtnau (DE)

( * ) Notice: Subject to any disclaimer, the term of this patent is extended or adjusted under 35 U.S.C. 154(b) by 164 days.

(21) Appl. No.: 16/641,729

(22) PCT Filed: Aug. 14, 2018

(86) PCT No.: PCT/EP2018/071998
§ 371 (c)(1),
(2) Date: Feb. 25, 2020

(87) PCT Pub. No.: WO2019/057400
PCT Pub. Date: Mar. 28, 2019

(65) Prior Publication Data

US 2020/0229587 A1 Jul. 23, 2020

(30) Foreign Application Priority Data

Sep. 20, 2017 (DE) ..... 102017121811.4
Jun. 12, 2018 (DE) ..... 102018114031.2

(51) Int. Cl.

| | |
|---|---|
| ***A46D 1/05*** | (2006.01) |
| ***A46B 3/18*** | (2006.01) |
| ***A46D 9/00*** | (2006.01) |
| ***A46D 9/02*** | (2006.01) |
| ***B08B 5/02*** | (2006.01) |

(52) U.S. Cl.
CPC ..... *A46D 1/05* (2013.01); *A46B 3/18* (2013.01); *A46D 9/00* (2013.01); *A46D 9/02* (2013.01); *B08B 5/02* (2013.01); *A46B 2200/108* (2013.01)

(58) Field of Classification Search
CPC ... A46D 1/05; A46D 9/00; A46D 9/02; A46D 1/04; A46D 1/0284; A46B 3/18; Y10S 451/916
USPC ..... 300/21, 1, 2, 17, 10; 15/339; 451/916
See application file for complete search history.

(56) References Cited

U.S. PATENT DOCUMENTS 5,653,628 A 8/1997 Weihrauch

FOREIGN PATENT DOCUMENTS

| | | | |
|---|---|---|---|
| DE | 19500145 | 5/1996 | |
| EP | 0189067 A2 * | 7/1986 | ..... A46D 9/00 |
| JP | H08224127 | 9/1996 | |
| JP | 2014094129 | 5/2014 | |
| JP | 2014094133 | 5/2014 | |

(Continued)

OTHER PUBLICATIONS

Translation of JP2014094129A retrieved from Espacenet on Dec. 15, 2021 (Year: 2014).*

(Continued)

*Primary Examiner* — Orlando E Aviles
*Assistant Examiner* — Thomas Raymond Rodgers
(74) *Attorney, Agent, or Firm* — Volpe Koenig

(57) ABSTRACT

A method and device (1) for producing and machining screwed-in brushes (2). In the method and in the device, at least one grinding sleeve (4) is used to grind down free bristle ends (5) of a brush (2) to be machined and thus remove edges and/or burrs on the free bristle ends (5).

32 Claims, 5 Drawing Sheets

(56) References Cited

FOREIGN PATENT DOCUMENTS

| | | | | |
|---|---|---|---|---|
| TW | 201240769 | | 10/2012 | |
| WO | WO-2010151117 | A1 * | 12/2010 | ..... A46B 17/06 |

OTHER PUBLICATIONS

Translation of EP0189067A2 retrieved from Espacenet on Dec. 15, 2021 (Year: 1986).*
Japanese Office Action in JP 2020-511904, dated Jun. 24, 2022.

* cited by examiner

METHOD AND DEVICE FOR MACHINING SCREWED-IN BRUSHES

TECHNICAL FIELD

The invention relates to a method and a device for machining screwed-in brushes, in particular for machining interdental brushes.

BACKGROUND

Screwed-in brushes are known in different embodiments from the prior art. They are used, inter alia, as what are referred to as interdental brushes and are used to clean interdental spaces. When said brushes are used, bristle ends of bristle filaments of the brushes generally come directly into contact not only with the tooth flanks to be cleaned, but also with the comparatively sensitive gum of the user. The sensitive gum may be injured by contact with the bristle ends.

SUMMARY

It is therefore the object of the invention to provide a method and a device of the type mentioned at the beginning which reduce or even avoid the risk of injuries to the gum of a user during the use of such screwed-in brushes.

This object is achieved in the case of a method of the type mentioned at the beginning by the use of one or more means and features of the invention which is focused on such a method. In particular, in order to achieve the object in the case of the method for machining screwed-in brushes, free bristle ends of a screwed-in brush are abraded with an abrasive sleeve. Possibly present burrs or sharp edges at the free bristle ends of the screwed-in brushes can thereby be rounded.

Such sharp edges or burrs have indeed been identified as a possible cause of injuries to the gum of a user, which, as described previously, are worth avoiding. Due to the comparatively small dimensions of the brush and of the bristle filaments thereof, in particular in the case of interdental brushes, rounding or rounding off of the bristle ends has hitherto been possible only with a disproportionately large outlay or has even not been attempted.

The previously described sharp edges or burrs may occur at the bristle ends during the cutting or shortening of the individual bristle filaments to the correct length during the production of the brushes.

The brush can be first of all introduced, at least with its set of bristles, into the abrasive sleeve before the free bristle ends of the brush are abraded. The brush can be introduced into the abrasive sleeve by an introducing movement of the brush relative to the abrasive sleeve, by a plugging-on movement of the abrasive sleeve, which is executed relative to the brush, or by a combined movement of brush and abrasive sleeve. The brush can be arranged centered within the abrasive sleeve in the machining position. This promotes a simultaneous and uniform machining of the free bristle ends of the set of bristles.

The abrasive sleeve used for abrading the free bristle ends of the brushes can have a rough surface or can be coated with an abrasive material on its inner side which faces the brush and its set of bristles during use of the abrasive sleeve.

It may be advantageous if the abrasive sleeve is moved relative to the brush in order to produce an abrasion movement. It is also possible to move the brush relative to the abrasive sleeve in order to produce the previously mentioned abrasion movement for abrading the bristle ends. In a further embodiment of the method, it can also be provided to move the abrasive sleeve relative to the brush and to move the brush relative to the abrasive sleeve.

In order to produce the abrasion movement, the brush and/or the abrasive sleeve can be rotated about a longitudinal center axis of the brush and/or of the abrasive sleeve. It is thereby possible to uniformly abrade the bristle ends of the bristle filaments of the screwed-in brush, to remove burrs and/or sharp edges and thus to round the bristle ends. It may be particularly expedient if the brush and the abrasive sleeve, if both are driven and moved in order to produce the abrasion movement, are each rotated in an opposite direction of rotation.

Additionally or alternatively thereto, it can also be provided to move the brush and/or the abrasive sleeve linearly or axially with respect to a longitudinal center axis of the brush and/or abrasive sleeve. The linear or axial relative movement thus produced can be combined with a rotating relative movement of brush and/or abrasive sleeve. A particularly thorough, but nevertheless rapid machining of the free bristle ends of the screwed-in brushes is thereby possible.

When brush and abrasive sleeve are positioned in the machining position, it can be advantageous for a uniform machining of the free bristle ends if a longitudinal center axis of the brush and a longitudinal center axis of the abrasive sleeve are congruent.

In a particularly advantageous embodiment of the method, the brush and/or the abrasive sleeve can first of all be rotated in a first direction of rotation and subsequently in a second opposite direction of rotation. This promotes a uniform abrading machining of the bristle ends of the screwed-in brushes.

In order to obtain a particularly fine final machining and rounding of the bristle ends of the brush, a brush can be successively machined by at least two abrasive sleeves. It is possible here for the at least two abrasive sleeves used for machining the brush to have different degrees of abrasion. It is thus conceivable to use a first abrasive sleeve having a rougher degree of abrasion in order first of all to roughly machine the brush. Subsequently, use can be made of a further abrasive sleeve which has a finer degree of abrasion and therefore permits a finer abrading machining of the bristle ends of the screwed-in brush.

The object mentioned at the beginning is also achieved with a device for machining screwed-in brushes, which device has one or more of the means and features of the invention focused on such a device. In particular, in order to achieve the object, in the case of a device mentioned at the beginning for machining screwed-in brushes, the device has at least one clamping device for a screwed-in brush and at least one abrasive sleeve for abrading free bristle ends of a brush clamped in the clamping device. A device for machining screwed-in brushes is thereby created which permits a final rounding of bristle ends of screwed-in brushes and which can also be configured for carrying out the previously described method claimed in the corresponding claims.

The at least one abrasive sleeve of the device can expediently be configured for receiving at least one set of bristles of the brush which is to be machined. This can mean that a depth of the at least one abrasive sleeve corresponds to at least one dimension of the set of bristles, as measured along a longitudinal center axis of the brush. The brush can thereby be completely plugged at least with its set of bristles into the abrasive sleeve in order to abrade the free bristle ends of the screwed-in brush.

It may be advantageous if a length of an abrasive surface of the abrasive sleeve, which can be measured in the plugging-in direction of the brush into the abrasive sleeve, is at least the same size as a length of the set of bristles of the brush, which can be measured in the same direction.

In principle, it is, of course, also possible to provide an abrasive sleeve, the abrasive surface of which has a length which can be measured in the plugging-in direction of the brush into the abrasive sleeve and is shorter than a length of the set of bristles, which can be measured in the same direction. In the case of an abrasive sleeve of this type, the brush is intended to be guided with its entire set of bristles at least once, but preferably several times, along the abrasive surface, for thorough machining of its free bristle ends.

Furthermore, the device can be configured to move the clamping device and/or the abrasive sleeve in order to produce an abrasion movement for machining the free bristle ends of the brush. A device is thereby created which is configured for producing a movement of the abrasive sleeve relative to the clamping device or vice versa. Rotating and linear or axial relative movements are suitable here as relative movements.

In order to produce an abrasion movement, the clamping device and/or the abrasive sleeve can be rotated about a longitudinal center axis of the brush and/or of the clamping device and/or of the abrasive sleeve. Furthermore, it is possible to move the clamping device and/or the abrasive sleeve linearly with respect to a longitudinal center axis of the brush and/or of the clamping device and/or of the abrasive sleeve. It can be particularly advantageous if a linear movement can be combined with a rotating movement in order to produce a complex or combined abrasion movement. For example, it is thus possible to drive the abrasive sleeve in a rotating manner about a longitudinal center axis of the abrasive sleeve while the clamping device with a brush clamped thereon is set into an axial movement relative to the rotating abrasive sleeve. This axial relative movement which can be carried out with the clamping device can preferably be an alternating axial movement. A particularly thorough abrading machining of the free bristle ends of the screwed-in brush can thereby be obtained.

The abrasive sleeve and the clamping device can be oriented relative to each other in the machining position in such a manner that their longitudinal center axes are congruent.

The device can have a rotation drive. By use of the rotation drive, the abrasive sleeve and/or the clamping device can be set into rotation. Furthermore, it is possible for the device to have a linear drive with which the clamping device and/or the abrasive sleeve are/is movable linearly or axially. In a particularly advantageous embodiment of the invention, the device has a rotation drive for the at least one abrasive sleeve. The at least one abrasive sleeve can thus be set into rotation relative to the at least one clamping device and therefore relative to a clamped brush. In addition thereto, the device can be equipped with a linear drive with which the at least one clamping device for the screwed-in brush is movable linearly relative to the rotatable abrasive sleeve. A device for machining screwed-in brushes is thereby created which is configured for producing a complex and/or combined abrasion movement.

In order to be able to reliably remove abrasion dust which occurs during the abrading machining of the screwed-in brushes from the process, the device can have a suction device with at least one suction opening. This at least one suction opening can be assigned to the at least one abrasive sleeve. It can be particularly advantageous if a plurality of suction openings are provided or if even each abrasive sleeve of the device is assigned at least one suction opening. The abrasion dust occurring during the abrading of the screwed-in brushes can thus be reliably removed.

In an embodiment of the device, the latter is designed as a carousel machine and has a plurality of revolving clamping devices along a closed path for screwed-in brushes. A device of the type mentioned at the beginning is thereby created which is suitable for simultaneously machining a plurality of screwed-in brushes. The clamping devices can be arranged here on a common holding ring of the device. This holding ring can be rotated about an axis of rotation of the device by a carousel drive. The individual screwed-in brushes which can be clamped on the plurality of clamping devices can thus be supplied gradually to the individual stations of the device, for example to individual or a plurality of abrasive sleeves of the device.

It can be advantageous in this connection if the device has at least two or three or more abrasive sleeves. Each of the present abrasive sleeves can in this case have its own degree of abrasion, and therefore a sequential machining of brushes with abrasive sleeves of a differing degree of abrasion is possible. A brush can thereby be machined, for example, first of all with an abrasive sleeve which has a comparatively rough degree of abrasion. The brush can subsequently be supplied to further abrasive sleeves with the degree of abrasion becoming ever finer. Burrs or sharp edges at the free bristle ends can thus be gradually reliably abraded and the bristle ends rounded.

If the device has a cleaning device for machined brushes, it is possible to free the brushes from possibly adhering abrasion dust and to clean them for downstream process steps. For this purpose, it may be advantageous if the cleaning device of the device is a compressed air cleaning device. It is then possible, in combination with the previously described suction device, to blow off the machined brushes and to remove the abrasion dust detached by the blowing-off operation from the device for machining screwed-in brushes with the aid of the suction device.

Furthermore, the device can have a cleaning station for the at least one clamping device. The cleaning station here can be configured in particular for cleaning a collet chuck of the at least one clamping device. A screwed-in brush can be clamped during its machining in the device with a collet chuck. With the aid of the cleaning station, the at least one clamping device can be cleaned after the complete machining of a screwed-in brush before a further use.

The at least one abrasive sleeve can have an inner abrasive surface. This inner abrasive surface can be provided and/or coated with an abrasive material. When an abrasive sleeve is used, said inner abrasive surface can have, for example, the form of a lateral cylinder surface.

The at least one abrasive sleeve can be composed of an abrasive block or else of an abrasive paper wound to form a sleeve. However, the at least one abrasive sleeve can also be produced in a generative production method, in particular can be sintered or 3D-printed.

Such abrasive sleeves which are composed of an abrasive block can be produced from a cast abrasive block. This makes it possible to produce comparatively complex abrasive sleeve geometries in a particularly simple manner. The same also applies to abrasive sleeves which are produced in a generative production method. In this case too, complex abrasive sleeve geometries can be produced comparatively simply.

In a particularly advantageous embodiment of the device, the at least one abrasive sleeve can have at least one cross-sectional constriction on its inner circumferential wall. This cross-sectional constriction can be in the form of an obstacle and/or a collar. With the aid of the cross-sectional constriction in the interior of the abrasive sleeve, an abrasive force on free bristle ends of the screwed-in brush can be increased. This occurs in particular if the abrasive sleeve and/or the brush are/is intended to be moved not only in a rotating manner but also with a linear relative movement with respect to each other in order to produce an abrasion movement.

The cross-sectional constriction in the abrasive sleeve can run, for example, helically about the longitudinal center axis of the abrasive sleeve. However, it is also possible to provide two or more cross-sectional constrictions in the interior of an abrasive sleeve, which cross-sectional constrictions are arranged at an axial distance from one another in the abrasive sleeve. The at least one cross-sectional constriction within the abrasive sleeve can also be coated or provided with an abrasive material.

In addition, between the cross-sectional constriction and an inner circumferential wall of the abrasive sleeve, which inner circumferential wall is adjacent to the cross-sectional constriction, at least one oblique surface can be formed. This oblique surface can connect the cross-sectional constriction to the inner circumferential wall of the abrasive sleeve. Starting from the inner circumferential wall, the oblique surface can rise to the level of the cross-sectional constriction. This creates a flowing transition from the inner circumferential wall as far as the cross-sectional constriction within the abrasive sleeve and promotes a gentle, but nevertheless thorough abrading machining of the free bristle ends of the screwed-in brushes.

It can be advantageous if an inside diameter, in particular a greatest or an average inside diameter, of the at least one abrasive sleeve is smaller than an outside diameter of a set of bristles of the brush which is to be machined with the device. It can thereby be ensured that, when the brush is introduced into the abrasive sleeve and especially when the previously described abrasion movements are carried out, all of the relevant free bristle ends also actually enter into contact with the abrasive sleeve and the inner wall thereof. This specifically takes place in such a manner that material is actually also abraded at the free bristle ends of the screwed-in brush during the relative movement between brush and abrasive sleeve.

In one embodiment of the at least one abrasive sleeve, it is provided that the latter is designed as a single-part, preferably sintered and/or 3D-printed, abrasive sleeve. However, it is also possible to design the at least one abrasive sleeve as a multi-part, for example two-part or three-part or four-part, abrasive sleeve. Multi-part abrasive sleeves can be produced comparatively simply, for example, from individual machined, in particular milled individual parts or partial sleeves.

In one embodiment of the invention, it is provided that the at least one abrasive sleeve has an introducing cone. Introduction of a screwed-in brush into the abrasive sleeve is facilitated with the aid of said introducing cone.

In a further embodiment of the device, the latter can comprise a funnel plate which is arranged between the at least one clamping device and the at least one abrasive sleeve. The funnel plate can have an introducing cone which tapers toward the at least one abrasive sleeve. A longitudinal center axis of the introducing cone can preferably be congruent in this case with the longitudinal center axis of the abrasive sleeve arranged therebehind.

Merely for the sake of completeness, it is mentioned that such a funnel plate can have as many introducing cones as the number of abrasive sleeves the device has. Each present abrasive sleeve of the device can therefore each be assigned an introducing cone of the funnel plate.

If the at least one abrasive sleeve has at least one inner suction opening which opens into the abrasive sleeve, abrasion dust arising during the abrading of the free bristle ends can be removed during the abrasion process. The at least one inner suction opening can be part of the previously mentioned suction device.

In order to simplify the handling of the brushes which are to be machined with the device, before and after the machining thereof, the device can have an input and/or removal device for inputting and/or removing brushes.

In order to reduce a number of required drive motors for operating the different drive devices of the device, it can be advantageous if a plurality of drives, for example a linear drive and/or a rotation drive, with which the at least one abrasive sleeve and/or the at least one clamping device are/is movable in order to carry out an abrasion movement, are coupled to one another via coupling elements, in particular via toothed belts, gearwheels and/or racks.

Especially if the abrasive sleeve has an abrasive surface which has a length which can be measured in the plugging-in direction of the brush into the abrasive sleeve and is shorter than a length of the set of bristles, which can be measured in the same direction, it can be advantageous if the device, preferably the at least one clamping device, comprises at least one stabilizing sleeve. With such a stabilizing sleeve, a handle of a brush can be supported during the machining of the brush. In order to obtain a thorough machining of the set of bristles, it can be advantageous to move the brush several times through such an abrasive sleeve. The brush is intended to be grasped here as far as possible to the rear on its handle, for example with a collet chuck of the clamping device. The stabilizing sleeve can be used to bridge the distance between the gripping point and the set of bristles of the brush and to stabilize the handle of the brush. In addition, it can promote the precise introduction of a brush which is held at the proximal end of its handle into the abrasive sleeve.

In this connection, it may be advantageous if the device, in particular the at least one clamping device, comprises at least one holder for such a stabilizing sleeve. The holder can simplify the handling of the brushes during the machining thereof on the device.

If the stabilizing sleeve at its distal end facing a set of bristles of a brush in the use position has an outer bevel which forms an encircling supporting surface for bristle filaments of the brush, said bristle filaments being arranged proximally in the set of bristles, said proximal bristle filaments can be supported above all with the aid of the stabilizing sleeve when the brush is passed through an introducing cone of a funnel plate. Damage to the set of bristles of the brush during the machining thereof on the device can thus be avoided.

This previously mentioned stabilizing sleeve of the device can be part of the at least one clamping device. It is particularly preferred if the stabilizing sleeve is configured at least indirectly for the clamping of a brush. For this purpose, the stabilizing sleeve can have a clamping means. The at least one stabilizing sleeve can thereby take on a dual function: namely, firstly, to stabilize the brush which is to be machined, in particular in the region of its handle, and, secondly, to mount the brush and thus to secure same for the machining. A stabilizing sleeve of this type is particularly suitable for clamping brushes which have a comparatively short handle on which no set of bristles is formed. In this connection, it may be advantageous if the clamping means is arranged adjacent to a plug-in opening of the stabilizing sleeve, through which the brush can be introduced with its handle into the stabilizing sleeve.

The stabilizing sleeve can have a clamping sleeve as the clamping means. The clamping sleeve can be movable relative to the at least one stabilizing sleeve into a clamping position in order to fix a brush, which is plugged with its handle through the plug-in opening of the stabilizing sleeve into the stabilizing sleeve, on the stabilizing sleeve and therefore to mount same on the device. A stabilizing sleeve is thereby created which is configured, by its clamping sleeve, not only to support but also to clamp a brush during the machining on the device.

The clamping sleeve can be movable into the clamping position by an adjusting force of an adjusting element, in particular of a compression spring, said adjusting force being oriented into the clamping position. The adjusting element can be part of the at least one clamping device. The adjusting element can be a compression spring.

The clamping sleeve is preferably arranged within the previously mentioned stabilizing sleeve and can be movable along an imaginary longitudinal axis of the stabilizing sleeve from a starting position into the clamping position already mentioned previously.

The previously mentioned clamping sleeve can have at least one slot, i.e. can be slotted. It is thereby possible to reduce a clear inside diameter of the clamping sleeve by a clamping force which is introduced radially from the outside to the clamping sleeve or is deflected. If a brush is placed with its handle in the clamping sleeve, the clamping force required for the clamping of the brush can thus be transmitted via the slotted clamping sleeve to the handle of the brush.

In order to produce the clamping force, it may be expedient if the previously mentioned stabilizing sleeve has a clamping bevel. The clamping bevel can be an oblique surface which encircles around an imaginary longitudinal center axis of the stabilizing sleeve and against which the clamping sleeve, which is displaceable relative to the stabilizing sleeve, can be pushed with its free end. Brushes which have a comparatively short handle can be clamped particularly reliably with the aid of such a stabilizing sleeve if the clamping bevel is arranged adjacent to the plug-in opening of the stabilizing sleeve. The clamping sleeve which is preferably arranged within the stabilizing sleeve can thereby be pushed relatively closely up to the plug-in opening of the stabilizing sleeve and can be deformed there radially inward with the aid of the clamping bevel in order to hold the brush in a clamping manner by way of its short handle.

In one embodiment of the stabilizing sleeve, a distance between the clamping bevel and the plug-in opening can be smaller than a length of a handle of a brush to be clamped.

In particular if the clamping sleeve is moved into the clamping position by the adjusting element which has already been mentioned previously and is pressed there against the clamping bevel, a deformation of the preferably slotted clamping sleeve can be brought about. The deformation causes the clamping sleeve to be placed on the outer side against a brush handle arranged in the clamping sleeve and a clamping force required for the clamping of the brush can be transmitted to the handle. With the aid of the adjusting element, the clamping force can be maintained even when the device is without current. This is true in particular if the adjusting element is a compression spring.

The device, in particular the at least one clamping device of the device, can comprise at least a, for example the, holder already mentioned previously, for the stabilizing sleeve. A, for example the, adjusting element, already mentioned previously, and/or or a pressure transmission element connected to the clamping sleeve can be arranged in or on said holder.

The adjusting element and/or the pressure transmission element of the clamping sleeve are thereby particularly readily protected within the holder against external influences. The pressure transmission element can be a pressure plate which is connected to the clamping sleeve and against which the adjusting element, preferably the previously mentioned compression spring, can apply its adjusting force in order to displace the clamping sleeve into its clamping position.

In one embodiment of the device, the latter can be designed as what is referred to as a roller machine. Such a roller machine can have a clamping block which is rotatable about a rotation axis and on which a plurality of clamping devices are arranged. The rotation axis of the roller machine can preferably be oriented horizontally here in the use position of the roller machine.

In order to be able to fasten the at least one clamping device to the device with as little outlay as possible, it may be expedient if the at least one clamping device has at least one rapid clamping means, in particular on its holder which has already been mentioned previously. This at least one rapid clamping means can be arranged or formed, for example, on a baseplate of the clamping device.

The input device already mentioned previously can be configured for simultaneously inputting a plurality of brushes within one working cycle. Likewise, the removal device of the device can also be configured for simultaneously removing a plurality of brushes, which are machined on the device, within one working cycle.

In this connection, simultaneously can mean that the plurality of brushes can be introduced into the device or removed therefrom without conversion of the removal device or of the input device. The input device can have a number of input elements here which corresponds to the number of brushes to be input into the device and/or to be machined within one working cycle. Similarly, the removal device can also have a number of removal elements which corresponds to the number of brushes machined and/or to be removed within one working cycle of the device.

The device can furthermore have a monitoring device, for example with at least one camera. It is possible with the aid of the monitoring device to monitor an inputting, removal and/or also a correct clamping of at least one brush. Particularly preferably, for example, the previously mentioned input device can be assigned a camera and the previously mentioned removal device of the device can be assigned a further camera.

It can be checked with the aid of the two cameras whether the brushes have been correctly placed into the device, in particular into the at least one clamping device. With the aid of the further camera, the removal of the brushes from the at least one clamping device of the device can be monitored.

In order to be able to exchange the at least one abrasive sleeve when required rapidly and optionally even without using a tool, it may be expedient if the device has a rapid clamping device for the at least one abrasive sleeve. The at least one abrasive sleeve can be connected via said rapid clamping device, for example, to a rotation drive for the at least one abrasive sleeve. The device preferably has in each case one such rapid clamping device for each abrasive sleeve.

The input device can be connected via at least one supply line, for example via at least one supply tube, for brushes to a station mounted upstream of the device, in particular to a machine for producing brushes. Brushes can be supplied via the at least one supply line, for example by means of compressed air, from the upstream station of the input device to the device.

The removal device can be connected via at least one supply line, for example via at least one supply tube, for brushes to a station mounted downstream of the device, in particular to a further processing machine for brushes. The at least one supply line can also be used here for transporting the brushes. Via the at least one supply line of the removal device, brushes machined on the device can be supplied to a downstream further processing machine. The brushes can also be transported here with the aid of compressed air and/or positive pressure and/or negative pressure.

BRIEF DESCRIPTION OF THE DRAWINGS

Exemplary embodiments of the invention are described in more detail below with reference to the drawing. The invention is not restricted to the exemplary embodiments shown in the figures. Further exemplary embodiments of the invention emerge through a combination of the features of individual or a plurality of claims with one another and/or in a combination of individual or a plurality of features of the exemplary embodiments. In a greatly schematized illustration:

DETAILED DESCRIPTION

Figure 1:
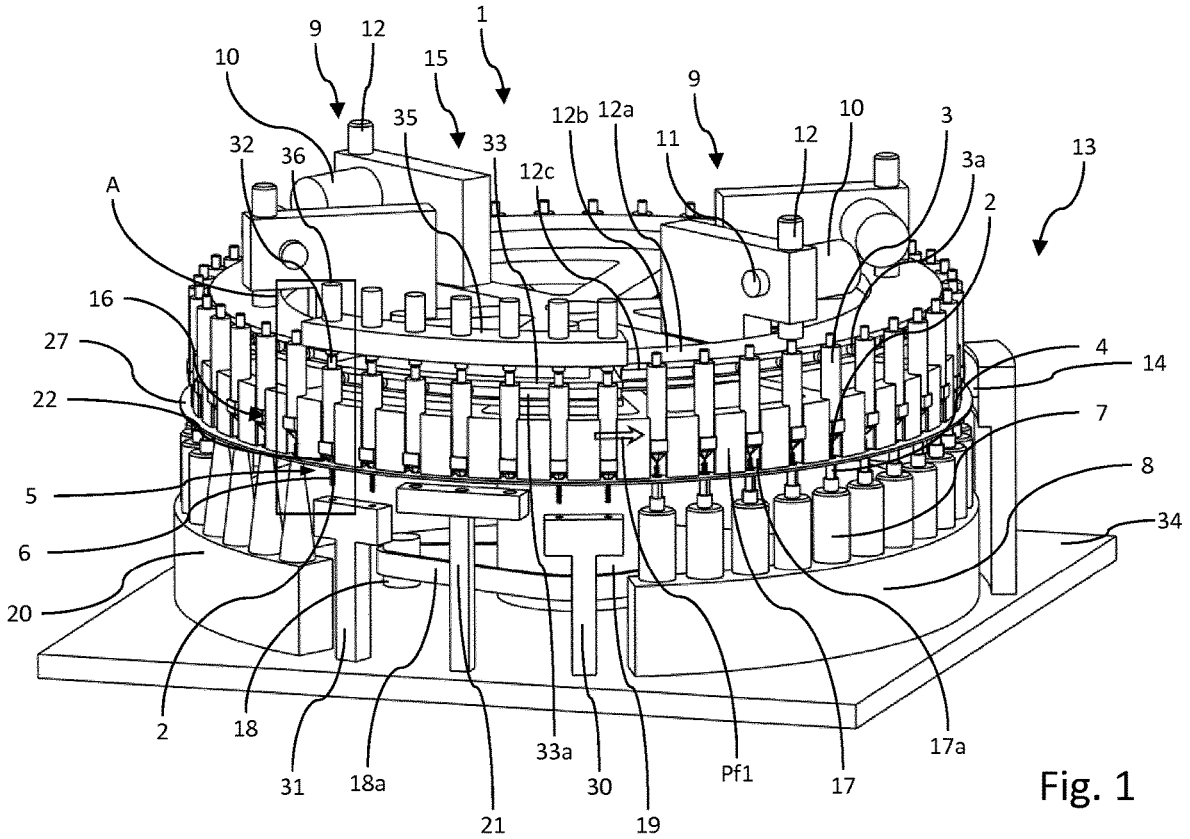
FIG. 1 shows a perspective view of a device according to the invention for machining screwed-in brushes, wherein the device is designed as a carousel machine and has a multiplicity of individual abrasive sleeves and clamping devices for screwed-in brushes.

In the description below of various embodiments of the invention, elements which correspond in terms of their function obtain corresponding reference numbers even if the design or shaping differs.

FIGS. 1, 2 and 9 and 12 each show at least parts of a device, denoted as a whole by 1, for machining screwed-in brushes. The brushes 2 illustrated in FIGS. 1, 2 and 9 and also 10 to 12 are referred to as interdental brushes 2.

The device 1 has a plurality of clamping devices 3 for screwed-in brushes 2 and a plurality of abrasive sleeves 4 for abrading free bristle ends 5 of the brushes 2 clamped in the clamping devices 3. Each of the abrasive sleeves 4 is configured for receiving at least one set of bristles 6 of the brushes 2 and is composed of two partial sleeves 4*a*. Some embodiments of suitable abrasive sleeves 4 and partial sleeves 4*a* are illustrated in FIGS. 3 to 9 and 12.

The device 1 is configured to move at least the abrasive sleeves 4 in order to produce an abrasion movement for machining the free bristle ends 5 of the brushes 2.

The abrasive sleeves 4 are rotatable about a longitudinal center axis of the brush 2, which is intended to be machined with the respective abrasive sleeve 4, and about a longitudinal center axis of the respective abrasive sleeve 4. The respective clamping device 3 together with the brush 2 clamped thereon is movable linearly with respect to a longitudinal center axis of the respective brush 2 and also with respect to a longitudinal center axis of the abrasive sleeve 4. An abrasion movement can thereby be produced if required even by combining a rotating relative movement of the abrasive sleeve 4 with respect to the clamping device 3 with a linear relative movement of the clamping device 3 with respect to the abrasive sleeve 4.

The device 1 has rotation drives 7 for the abrasive sleeves 4. Each abrasive sleeve 4 is in each case assigned a rotation drive 7. FIG. 1 clarifies that all of the rotation drives 7 are arranged on an adjustment device 8. The arrangement of the rotation drives 7 and of the abrasive sleeves 4 relative to the clamping devices 3 can be adapted with the adjustment device 8. The clamping devices 3 of the device 1 can be moved linearly or axially, i.e. raised and lowered, via a plurality of linear drives 9.

Each of the linear drives 9 in each case has a drive motor 10 which is drive-connected to a rack 12 via a drive pinion 11. A rotational movement of the drive motor 10 of the respective linear drive 9 can be converted into a lifting movement of the clamping devices 3 via the drive pinion 11 and the rack 12. For this purpose, the racks 12 are connected to a movable guide ring 12*a* which, in more precise terms, is in the form here of a ring segment which extends over an angular range of approximately 300 degrees. The guide ring 12*a* has a guide groove 12*c* on its circumferential side 12*b*. The clamping devices 3 are equipped with guide rollers 3*a*. The clamping devices 3 run with said guide rollers 3*a* through the guide groove 12*c*. Via the guide rollers 3*a* arranged in the guide groove 12*c*, a lifting movement of the guide ring 12*a* that is caused by the linear drives 9 can be transmitted to the clamping devices 3 and ultimately also to the brushes 2 clamped therein. The clamping devices 3 running in the guide groove 12*c* are therefore raised or lowered together with the guide ring 12*a* in order to position the brushes 2 in the abrasive sleeves 4 and optionally further machining stations of the device 1.

According to FIG. 1, the device 1 has a suction device 13 with suction openings 14. Of said suction openings 14, a suction opening 14 is illustrated in highly schematized form in FIG. 1. Each clamping device 3 and/or each abrasive sleeve 4 can in each case be assigned one such suction opening 14 in order to reliably remove abrasion dust occurring during the abrading of the brushes 2. Advantageously, a sufficient number of such suction openings 14 are provided here in order to be able to grasp all of the abrasive sleeves 4 and/or clamping devices 3 with the suction.

According to FIG. 1, the device 1 is designed as a carousel machine 15. The device 1 has a plurality of clamping devices 3 revolving along a closed path 16. The clamping devices 3 are arranged in a common holding ring 17 of the device 1 and are held in a manner guided in the guide ring 12*a* which has already been described previously. The holding ring 17 is rotated about an axis of rotation 19 of the device 1 by a carousel drive 18, but is neither raised nor lowered. The arrow Pf1 indicates the direction of rotation of the holding ring 17. The carousel drive 18 is connected to the axis of rotation 19 of the device 1 via a belt 18*a*. The axis of rotation 19, for its part, is connected to the holding ring 17 for rotation therewith, and therefore a rotation of the axis of rotation 19 can be transmitted to the holding ring 17 and to the clamping devices 3 arranged thereon. The clamping devices 3 which are arranged on the holding ring 17 can thereby revolve together with the holding ring 17 on the closed path 16 and can be supplied successively to the individual machining stations, in particular to the abrasive sleeves 4 of the device 1.

The holding ring 17 has a respective receptacle 17*a* for each clamping device 3. In these receptacles 17*a*, the clamping devices 3 are indeed guided in a longitudinally displaceable manner in the direction of a longitudinal axis of the receptacles 17*a*, but in a manner secured against rotation.

In addition, the device 1 has a cleaning device 20. The cleaning device 20 is designed as a compressed air cleaning device and serves to clean machined brushes 2 after they have been machined by abrasion.

Apart from the cleaning device 20, the device 1 also has a cleaning station 21 for the clamping devices 3 of the device 1. In said cleaning station 21, collet chucks 22 of the individual clamping devices 3 can be cleaned after machining of brushes 2 is finished and can be prepared for a subsequent machining cycle.

Figure 2:
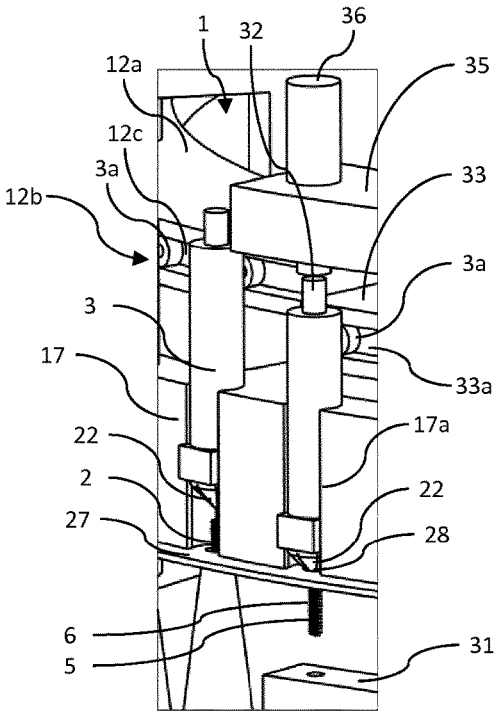
FIG. 2 shows the detail marked by the rectangle A in FIG. 1 in an enlarged illustration.
Figure 3:
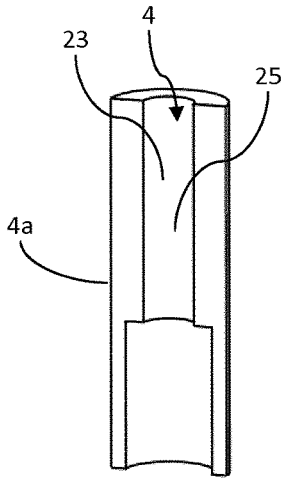
FIGS. 3 to 8 show perspective side views of different embodiments of partial sleeves, from which abrasive sleeves are composed which can be used on the device illustrated in FIGS. 1 and 2, wherein some of the partial sleeves illustrated have inner cross-sectional constrictions and/or suction openings which open into the interior of the respective partial sleeve.

FIGS. 3 to 8 show different embodiments of divided abrasive sleeves 4 which can be used on the device 1 illustrated in FIGS. 1 and 2. For reasons of better clarity, for each of the abrasive sleeves 4 illustrated in FIGS. 3 to 8 in each case only one of two partial sleeves 4*a*, of which each abrasive sleeve 4 consists, is illustrated. Each of the illustrated abrasive sleeves 4 in each case has an inner abrasive surface 23 which is provided or is coated with an abrasive material.

The abrasive sleeves 4 can be comprised of different materials and can be produced in different methods. For example, in one embodiment of such an abrasive sleeve 4 it is thus provided that the latter consists of a cast abrasive block. However, it is also possible to produce an abrasive sleeve 4 from an abrasive paper wound to form a sleeve. However, in particular what are referred to as single-part abrasive sleeves 4 can also be produced by generative production methods. It is, for example, conceivable in this case to sinter the abrasive sleeves 4 or to produce them by 3D printing.

The abrasive sleeves 4 illustrated in FIGS. 5 to 9 each have a plurality of cross-sectional constrictions 24 on their inner circumferential walls 25. These cross-sectional constrictions 24 can be present, for example, in the form of a collar or an obstacle. In the case of the abrasive sleeves 4 illustrated in FIGS. 5 to 8, cross-sectional constrictions 24 are provided which are arranged at an axial distance from one another in the abrasive sleeve 4 in a manner distributed uniformly along the longitudinal center axis of the respective abrasive sleeve 4.

The cross-sectional constrictions 4 are flanked on both sides by a respective oblique surface 26 which runs between an inner circumferential wall 25 of the abrasive sleeve 4 that is adjacent to the cross-sectional constriction 24 and the cross-sectional constriction 24. At least an average inside diameter of the abrasive sleeves 4 illustrated in FIGS. 3 to 8 is smaller than an outside diameter of a set of bristles 6 of the brushes 2 to be machined with the device 1.

The abrasive sleeves 4 illustrated in FIGS. 3 to 8 are what are referred to as two-part abrasive sleeves 4 which consist of two partial sleeves 4*a* produced separately from each other. Each of the partial sleeves 4*a* of the abrasive sleeves 4 illustrated in FIGS. 3 to 8 can be, for example, first of all milled and then assembled together with a second partial sleeve 4*a* to form an abrasive sleeve 4.

The abrasive sleeves 4 illustrated in FIG. 1 each consist of two such partial sleeves 4*a*. In addition, the device 1 has a funnel plate 27. This funnel plate 27 is of annular design and is arranged between the clamping devices 3 and the abrasive sleeves 4. The funnel plate 27 comprises a respective introducing cone 28 at least for each abrasive sleeve 4 into which a brush 2 is intended to be introduced for the machining. Each of the introducing cones 28 tapers toward the abrasive sleeve 4 assigned thereto. This makes it easier to introduce the brushes 2 into the abrasive sleeves 4. A longitudinal center axis of the respective introducing cone 28 is congruent here with a longitudinal center axis of the abrasive sleeve 4 which is assigned thereto and is arranged behind the introducing cone 28.

Figure 4:
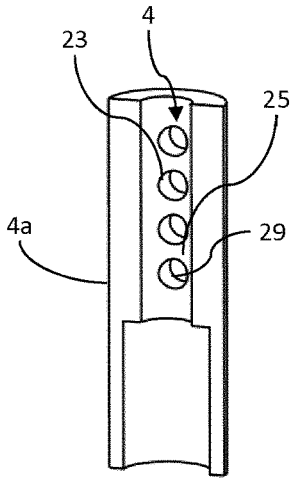
Figure 5:
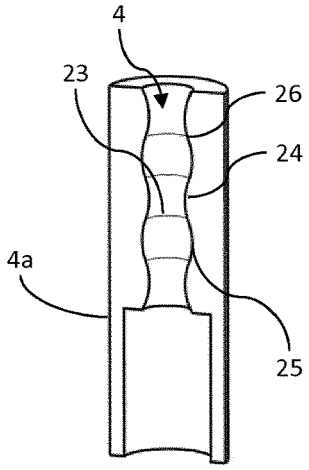
Figure 6:
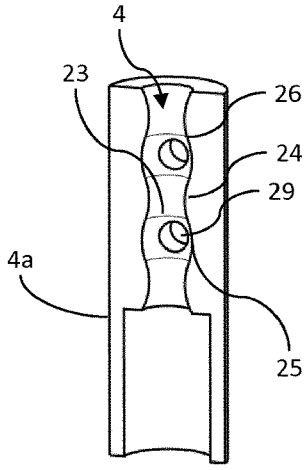
Figure 7:
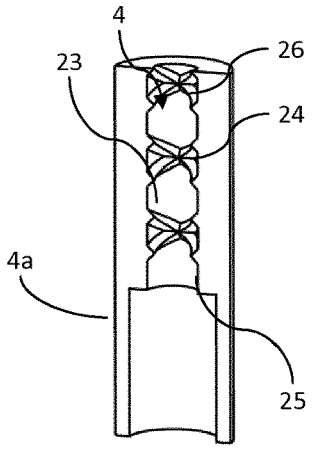
Figure 8:
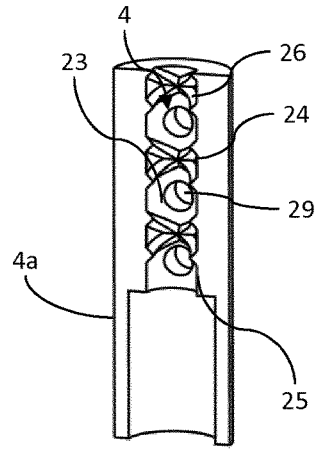

The abrasive sleeves 4 illustrated in FIGS. 4, 6 and 8 each have between two and four inner suction openings 29 which open into the interior of the abrasive sleeves 4. The suction openings 29 are arranged here in the interior of the abrasive sleeves 4 in such a manner that they can as far as possible grasp the entire abrasive surface 23 with the suction.

The device 1 also comprises an input device 30 and a removal device 31 in order to be able to insert brushes 2 comfortably into the device 1 and in particular into the clamping devices 3 of the device 1 and also to be able to remove them again from the clamping devices 3 after the brushes 2 have been machined.

For the removal of brushes 2 from the clamping devices 3, the removal device 31 actuates an opening pin 32 which is connected to the respective collet chuck 22. By actuation of the opening pin 32, the respective collet chuck 22 of the clamping device 3 is opened and the brush 2 clamped therein can be removed from the clamping device 3. In order to operate the opening pins 32, openers 36 are provided which are arranged on a holder 35 of the removal device 31, actuate the opening pins 32 and therefore open the collet chucks 22 of the clamping devices 3.

The device 1 has a guide segment 33 in the region of the input device 30 and of the removal device 31. The guide segment 33 is fixed on a framework 34 of the device 1 and is unchangeable in its position. The guide segment 33—like the guide ring 12*a*—has a guide groove 33*a* into which the clamping devices 3 run with their guide rollers 3*a* when they pass through the holding ring 17 into the corresponding position on the device 1.

Figure 9:
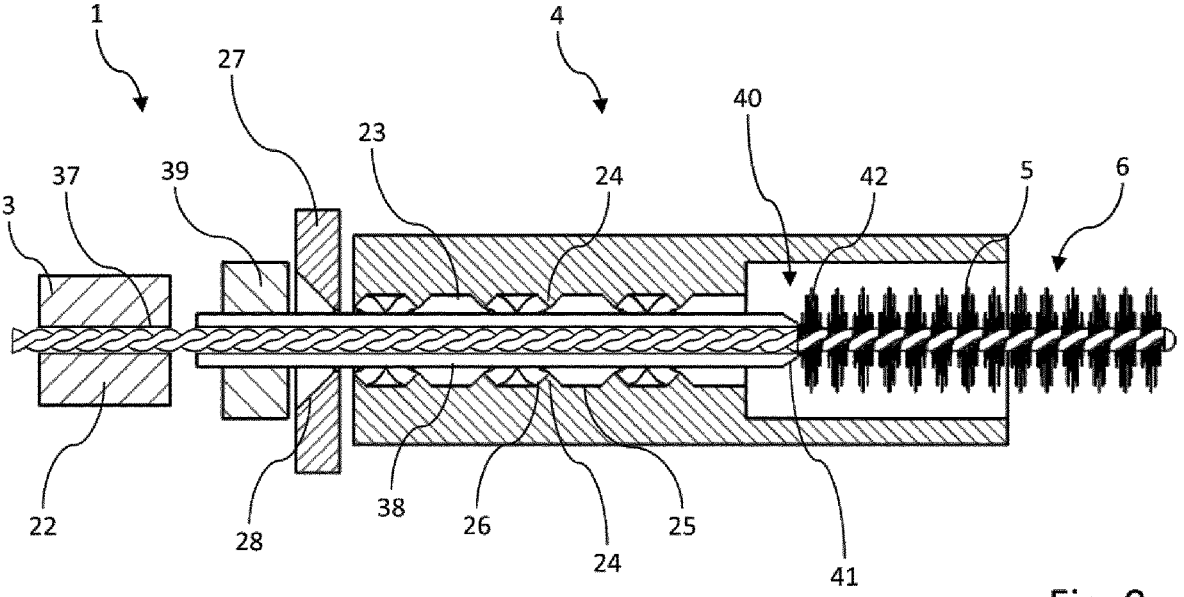
FIG. 9 shows a highly schematized sectional illustration of a further abrasive sleeve with inner cross-sectional constrictions and with a brush which is introduced into the abrasive sleeve and the handle of which is surrounded at least in sections by a stabilizing sleeve.

FIG. 9 shows a further embodiment of an abrasive sleeve 4. The length of the abrasive surface 23 of said abrasive sleeve 4, as can be measured in the plugging-in direction of the brush 2, is shorter than the length of the set of bristles 6 of the brush 2, as can be measured in the plugging-in direction of the brush 2.

In order to machine the brush 2 with said abrasive sleeve 4, the brush 2 can be pushed once or repeatedly through the abrasive sleeve 4. For this purpose, it is advantageous to grasp the brush 2 as far to the rear as possible on its handle 37. According to FIG. 9, the collet chuck 22 of the clamping device 3 of the device 1 therefore also attaches to the proximal end of the handle 37 of the brush 2.

A comparatively large distance which can impair the introducing of the brush 2 into the abrasive sleeve 4 arises between the collet chuck 22 and the set of bristles 6 of the brush 2. The clamping device 3 of the device 1, only illustrated in sections in FIG. 9, therefore has a stabilizing sleeve 38. The latter surrounds the handle 37 of the brush 2 in a supporting manner during the machining of the set of bristles 6 in the abrasive sleeve 4 and thereby stabilizes the brush 2.

The device 1 illustrated in FIG. 9 is furthermore equipped with a holder 39. This holder 39 is an element of the clamping device 3 and holds the stabilizing sleeve 38 during the machining of the brush 2.

FIG. 9 furthermore shows that the stabilizing sleeve 38 has an outer bevel 41 at its distal end 40 which faces the set of bristles 6 of the brush 2. This bevel 41 forms an encircling supporting surface against which at least the bristle filaments 42 arranged proximally in the set of bristles 6 can be placed during the introduction of the brush 2 through the introducing cone 28 of the funnel plate 27 into the abrasive sleeve 4.

The method described below can be carried out on the device 1 described above:

It is provided in the method for machining screwed-in brushes 2 that free bristle ends 5 of the brush 2 are abraded with an abrasive sleeve 4. This is undertaken with the aim of rounding off free bristle ends 5 of the brush 2. For this purpose, a screwed-in brush 2 is introduced with at least one section, namely with its set of bristles 6, into the abrasive sleeve 4.

The abrasive sleeve 4 is then moved relative to the brush 2 and optionally the brush 2 is also moved relative to the abrasive sleeve 4, in order to produce an abrasion movement.

While the abrasive sleeve 4 is rotated about a longitudinal center axis of the brush 2 and also about a longitudinal center axis of the abrasive sleeve 4, wherein the longitudinal center axis of the brush 2 and the longitudinal center axis of the abrasive sleeve 4 are congruent when the abrasive sleeve 4 and brush 2 are in the abrasion position, the brush 2 is moved relative to the abrasive sleeve linearly or axially with respect to a longitudinal center axis of the brush 2 and also with respect to a longitudinal center axis of the abrasive sleeve 4.

The linear or axial relative movement is combined here with the rotating relative movement of brush 2 and abrasive sleeve 4. In one embodiment of the method, the abrasive sleeve 4 is rotated relative to the brush 2 first of all in a first direction of rotation and subsequently in a second opposite direction of rotation in order to abrade and to round off the free bristle ends 5 of the brush 2. In order to machine the bristle ends 5 of the brush 2 by abrasion, for example successively in different abrasive steps, the brush 2 can be successively supplied to at least two different abrasive sleeves 4 and machined by the latter.

Figure 10:
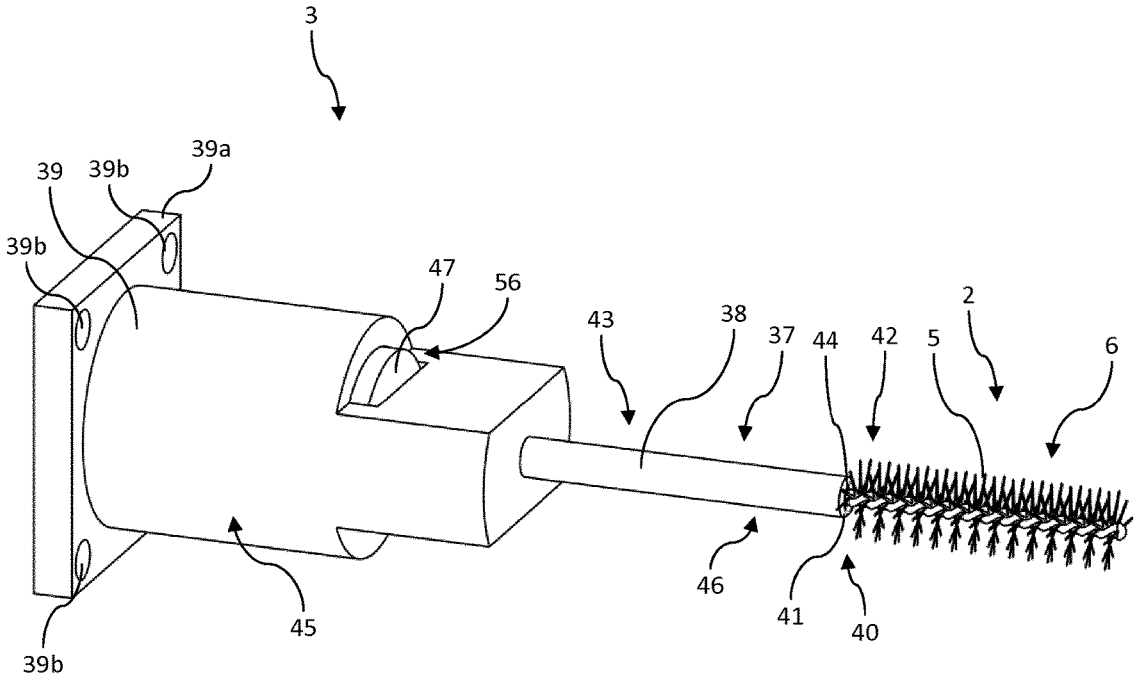
FIG. 10 shows a perspective side view of a further embodiment of a clamping device for the clamping of a brush, wherein the clamping device has a stabilizing sleeve, in the interior of which an axially displaceable clamping sleeve is arranged.
Figure 11:
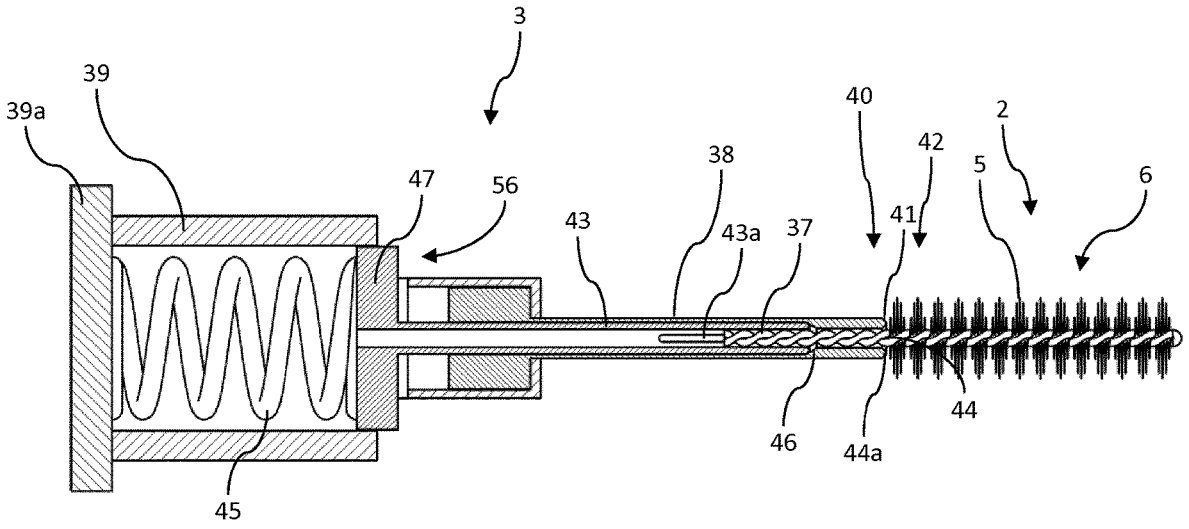
FIG. 11 shows a sectioned side view of the clamping device shown in FIG. 10.
Figure 12:
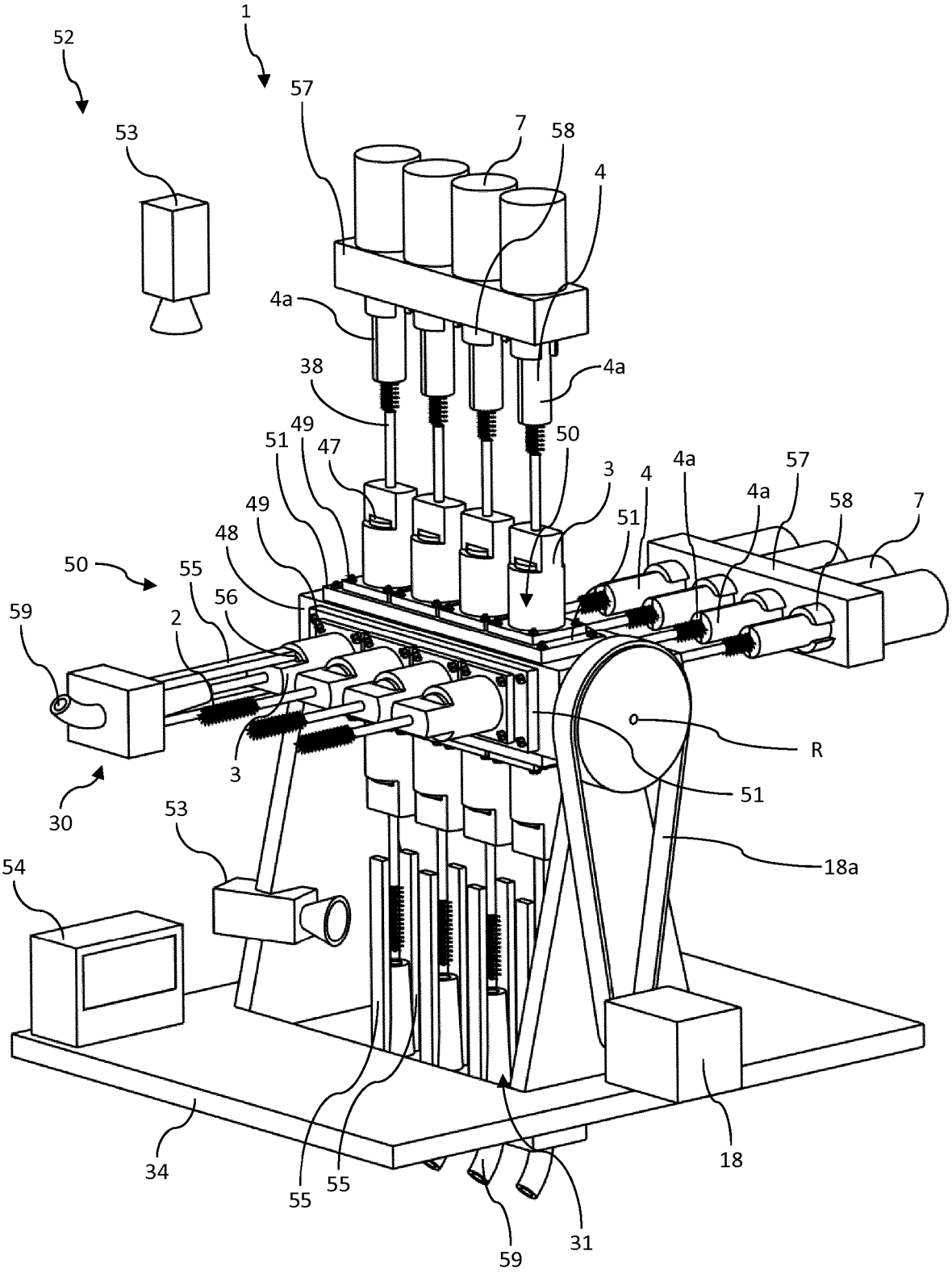
FIG. 12 shows a device designed as what is referred to as a roller machine for machining screwed-in brushes in a perspective view with clamping devices as are shown in FIGS. 10 and 11.

FIGS. 10 and 11 show a variant of a clamping device 3 which can likewise be used on the devices 1 shown in FIGS. 1 and 12.

This type of the clamping device 3 likewise has a stabilizing sleeve 38 with which a handle 37 of a brush 2 can be supported on or at the device 1 during the machining of the brush 2. The stabilizing sleeve 38 comprises a clamping means 43, by which the stabilizing sleeve 38 is at least indirectly configured for clamping a brush 2. The clamping means 43 is arranged adjacent to a plug-in opening 44 of the stabilizing sleeve 38 through which the brush 2 can be introduced with its handle 37 into the stabilizing sleeve 38. In order to facilitate introduction of a handle 37 of a brush 2, the stabilizing sleeve 38 has an introducing cone 44*a*.

As in the case of the embodiment of a clamping device 3 from FIG. 9, the stabilizing sleeve 38 of the clamping device 3 according to FIGS. 10 and 11 also has an outer bevel 41 at its distal end 40 which faces the set of bristles 6 of the brush 2. This bevel 41 forms an encircling supporting surface against which at least the bristle filaments of the brush 2 that are arranged proximally in the set of bristles 6 can be placed.

The clamping means 43 of the stabilizing sleeve 38 shown in FIGS. 10 and 11 is a clamping sleeve 43. The clamping sleeve 43 can be moved relative to the stabilizing sleeve 38 from a starting position into a clamping position. The sectional illustration of the clamping device 3 from FIG. 11 shows the clamping sleeve 43 in its clamping position in the interior of the stabilizing sleeve 38. The clamping sleeve 43 is moved into the clamping position shown in FIG. 11 and is also held there by an adjusting force of an adjusting element 45, which is designed here as a compression spring 45, said adjusting force being oriented into the clamping position.

The clamping sleeve 43 has a slot 43*a*, i.e. is slotted, and can thereby reduce its clear inside diameter by radially oriented pressure in order to securely clamp a handle 37 of a brush 2. In addition, the clamping sleeve 43, as already mentioned previously, is arranged within the stabilizing sleeve 38.

The stabilizing sleeve 38 has, in its interior, a clamping bevel 46 for deforming the clamping sleeve 43. The clamping bevel 46 is arranged adjacent to the plug-in opening 44, already mentioned previously, of the stabilizing sleeve 38. If the clamping sleeve 43 is moved against the clamping bevel 46 by the compression spring 45, the adjusting force of the compression spring 45 is deflected radially inward onto the clamping sleeve 43. The clamping sleeve 43 is thereby deformed with its clear inside diameter being reduced, and a handle 37, which is arranged therein, of a brush 2 is firmly clamped.

The clamping device 3 shown in FIGS. 10 and 11 has a holder 39 to which the stabilizing sleeve 38 is fastened. The adjusting element 45, namely the compression spring 45, and a pressure transmission element 47 connected to the clamping sleeve 43 are arranged in the holder 39. The pressure transmission element 47 is a pressure plate which is connected integrally to the clamping sleeve 43 and against which the compression spring 45 acts. The compression spring 45 transmits its adjusting force, which is oriented into the clamping position, to the clamping sleeve 43 via the pressure plate 47.

FIG. 12 shows a further embodiment of a device 1 according to the invention which has a total of eight abrasive sleeves 4 and is configured for carrying out the method according to the invention. The embodiment of the device 1 that is shown in FIG. 12 is designed as what is referred to as a roller machine which has a clamping block 48 which is rotatable about a rotation axis R. A plurality of clamping devices 3 are arranged on said clamping block 48. The clamping devices 3 of the device 1 from FIG. 12 that is designed as a roller machine are the same clamping devices 3 as are shown in FIGS. 10 and 11.

The clamping devices 3 shown in FIGS. 10 to 12 each have a plurality of holes 39*b* or bores for rapid clamping means 49 on their holder 39, more precisely on a baseplate 39*a* of their holder 39. With the aid of the rapid clamping means 49, the clamping devices 3 can be rapidly released from the clamping block 48 and ex-changed when required.

The clamping block 48 has a total of four clamping sides 50. A respective carrier plate 51 is arranged on each of the clamping sides 50. Each of the carrier plates 51 is fastened in turn to the clamping block 48 by rapid clamping means 49. A respective carrier plate 51 is fastened to each of the therefore total of four clamping sides 50 of the clamping block 48. Each of the carrier plates 51 carries a total of four clamping devices 3, and therefore the device 1 illustrated in FIG. 12 has a total of 16 clamping devices 3 for clamping a total of 16 brushes 2.

The clamping block 48 can be rotated about the rotation axis R of the clamping block 48 with the aid of a drive 18, which is connected to the clamping block 48 via a belt 18*a*, in order to be able to supply the total of four clamping sides 50 with the clamping devices 3 arranged thereon to the total of four stations of the device 1.

The input device 30 of the device 1 shown in FIG. 12 is configured to equip the in each case four clamping devices 3, which are in the input position, successively or sequentially with brushes 2 which are to be machined. In contrast thereto, the removal device 31 of the device 1 shown in FIG. 12 is configured to remove the four brushes 2, which are clamped to the four clamping devices 3 in the removal position, from the device 1 simultaneously. The machined brushes 2 can therefore be unloaded particularly rapidly.

The input device 30 has a pusher 55. The pusher 55 is used to act upon the pressure transmission element 47 and thus to move the clamping sleeve 43 from its clamping position into its starting position in order to introduce a handle 37 of a brush 2 into the stabilizing sleeve 38. For this purpose, the holder 39 of the clamping device 3 has an opening 56 from which the pressure transmission element 47 protrudes when the clamping sleeve 43 is in the clamping position. In this way, the pressure transmission element 47, although it is at least partially arranged within the holder 39, is accessible from the outside for the pusher 55 of the input device 30.

With a compressive force of the pusher 55, the adjusting force of the adjusting element 45 acting on the pressure transmission element 47 is overcome and the clamping sleeve 43 is moved out of its clamping position. If the brush 2 is introduced with its handle 37 into the stabilizing sleeve 38, the pusher 55 can be pulled back, as a result of which the adjusting element/the compression spring 45 is relaxed and pushes the clamping sleeve 43 back into its clamping position. The result is that the brush 2 is clamped via its handle 37 to the clamping device 3 with the aid of the clamping sleeve 43 arranged in the stabilizing sleeve 38.

The removal device 31 of the device 1 shown in FIG. 12 has a plurality of comparable pushers 55. The pushers 55 are used to open the clamping devices 3 which are in the removal position, i.e. to move the clamping sleeves 43 out of their clamping positions, in order to remove the brushes 2 clamped in the clamping devices 3.

The device 1 shown in FIG. 12 furthermore has a monitoring device 52. The monitoring device 52 has two cameras 53, of which one camera 53 is assigned to the input device 30 and another camera 53 is assigned to the removal device 31.

The camera 53 of the monitoring device 52 that is assigned to the input device 30 serves to monitor the inputting and correct clamping of the brushes 2 into/at the clamping devices 3 in the input position.

The camera 53 of the monitoring device 52 that is assigned to the removal device 31 is used to check the removal of the brushes 2 from the clamping devices 3 in the removal position. With the aid of a control unit 54 of the device 1 shown in FIG. 12, the device 1 is furthermore configured to control or to regulate the machining of the brushes 2 even depending on the states determined by the monitoring device 52 with the aid of its two cameras 53.

The device 1 shown in FIG. 12 has two abrasion stations 57 in which in each case four abrasive sleeves 4 are assembled. Each abrasive sleeve 4 consists of two partial sleeves 4*a*, as have already been described in detail further above. Each of the total of eight abrasive sleeves 4 of the device 1 illustrated in FIG. 12 is in each case assigned a rotation drive 7. In a variant of a device 1 that is not illustrated in the figures, a plurality of abrasive sleeves 4 can also be driven by a rotation drive 7.

The abrasion stations 57 each have a rapid clamping device 58 for each of their abrasive sleeves 4. With the aid of the rapid clamping devices 58, the abrasive sleeves 4 can be changed rapidly when required and optionally even without the use of a tool.

The input device 30 is connected via a supply line 59 in the form of a supply tube 59 for brushes 2 to a machine, which is mounted upstream of the device 1, for producing brushes 2. Brushes 2 can be supplied to the input device 30 and therefore to the device 1 by the supply tube 59. It is possible here to transport the brushes 2 by the supply tube 59 from the upstream machine to the input device 30 and thus to the device 1 by positive and/or negative pressure.

The removal device 31 is connected via a total of four supply lines 59, which are likewise designed as supply tubes 59, to a further processing machine mounted downstream of the device 1. Brushes 2 machined on the device 1 can be transported via the supply tubes 59 of the removal device 31 to the further processing machine mounted downstream of the device 1. Positive and/or negative pressure and/or compressed air can also be used here for transporting the brushes 2.

The invention is concerned with improvements in the technical field of producing and machining screwed-in brushes 2. To this end, the method and the device 1 are proposed. An abrasive sleeve 4 is used both in the method and in the device in order to abrade free bristle ends 5 of the brush 2 and thus to remove edges and/or burrs present at the free bristle ends 5.

LIST OF REFERENCE SIGNS

1 Device
2 Brush
3 Clamping device
3*a* Guide roller
4 Abrasive sleeve
4*a* Partial sleeve
5 Free bristle ends
6 Set of bristles
7 Rotation drive
8 Adjustment device
9 Linear drive
10 Drive motor
11 Drive pinion
12 Rack
12*a* Guide ring
12*b* Circumferential side of 12*a*
12*c* Guide groove
13 Suction device

14 Suction opening
15 Carousel machine
16 Closed path
17 Holding ring
17*a* Receptacles for 3 on 17
18 Carousel drive/drive
18*a* Belt
19 Axis of rotation
20 Cleaning device
21 Cleaning station
22 Collet chuck
23 Abrasive surface
24 Cross-sectional constriction
25 Inner circumferential wall
26 Oblique surface
27 Funnel plate
28 Introducing cone
29 Inner suction opening in 4
30 Input device
31 Removal device
32 Opening pin
33 Guide segment
33*a* Guide groove in 33
34 Framework
35 Holder
36 Opener
37 Handle of 2
38 Stabilizing sleeve
39 Holder for 38
39*a* Baseplate of 39
39*b* Hole in 39*a*
40 Distal end of 38
41 Bevel on 38
42 Proximal bristle filaments
43 Clamping means/clamping sleeve
43*a* Slot in 43
44 Plug-in opening
44*a* Introducing cone on 38
45 Adjusting element/compression spring
46 Clamping bevel
47 Pressure transmission element/pressure plate
48 Clamping block
49 Rapid clamping means
50 Clamping side
51 Carrier plate
52 Monitoring device
53 Camera
54 Control unit
55 Pusher of 30
56 Opening in 38
57 Abrasion station
58 Rapid clamping device
59 Supply line/supply tube

The invention claimed is:

1. A method for machining screwed-in brushes (2), the method comprising:

providing a clamping device (3) for the brush (2), providing an abrasive sleeve (4) configured to abrade free bristle ends (5) of the brush (2) clamped in the clamping device (3), providing a stabilizing sleeve (38), including a clamp of the clamping device that is configured for the clamping of the brush (2), the clamp is arranged adjacent to a plug-in opening (44) of the stabilizing sleeve (38), through which the brush (2) is introducible by a handle (37) thereof into the stabilizing sleeve (38), and the clamp comprises a clamping sleeve (43) that is movable relative to the stabilizing sleeve (38) into a clamping position by an adjusting force of an adjusting element (45), with the adjusting force being oriented into the clamping position, introducing the handle of the brush into the stabilizing sleeve (38) and supporting the handle therein and at least one holder for the stabilizing sleeve, wherein the stabilizing sleeve at a distal end thereof faces a set of bristles of the brush, clamping the brush (2) via moving the clamping sleeve (43) relative to the stabilizing sleeve (38) into the clamping position by the adjusting force of the adjusting element (45), and abrading free bristle ends (5) of the brush (2) with an abrasive sleeve (4).

2. The method as claimed in claim 1, further comprising before the abrading of the bristle ends (5), introducing the brush (2) at least with a set of bristles (6) thereof into the abrasive sleeve (4), and at least one of moving the abrasive sleeve (4) relative to the brush (2) or moving the brush (2) relative to the abrasive sleeve (4), in order to produce an abrasive movement.

3. The method as claimed in claim 2, further comprising rotating at least one of the brush (2) or the abrasive sleeve (4) about a longitudinal center axis of the brush (2) or of the abrasive sleeve (4).

4. The method as claimed in claim 3, further comprising moving at least one of the brush (2) or the abrasive sleeve (4) linearly or axially with respect to a longitudinal center axis of the at least one of the brush (2) or the abrasive sleeve (4).

5. The method as claimed in claim 3, further comprising the at least one of the brush (2) or the abrasive sleeve (4) being first rotated in a first direction of rotation and subsequently rotated in a second opposite direction of rotation.

6. The method as claimed in claim 1, further comprising machining the brush (2) successively by at least two of the abrasive sleeves (4).

7. A device (1) for machining screwed-in brushes (2), the device (1) comprising, at least one clamping device (3) for a brush (2), at least one abrasive sleeve (4) configured to abrade free bristle ends (5) of the brush (2) clamped in the at least one clamping device (3), and at least one stabilizing sleeve (38) with which a handle (37) of the brush (2) can be supported during the machining of the brush (2) and at least one holder for the at least one stabilizing sleeve, wherein the at least one stabilizing sleeve at a distal end thereof faces a set of bristles of the brush, the at least one stabilizing sleeve (38) includes a clamp of the at least one clamping device that is configured for the clamping of the brush (2), the clamp is arranged adjacent to a plug-in opening (44) of the at least one stabilizing sleeve (38), through which the brush (2) is introducible by the handle (37) thereof into the at least one stabilizing sleeve (38), and the clamp comprises a clamping sleeve (43) that is movable relative to one of the at least one stabilizing sleeve (38) into a clamping position by an adjusting force of an adjusting element (45), with the adjusting force being oriented into the clamping position.

8. The device as claimed in claim 7, wherein the at least one abrasive sleeve (4) is configured at least for receiving at least one set of bristles (6) of the brush (2), and at least one of the at least one clamping device (3) or the at least one abrasive sleeve (4), is configured to move in order to produce an abrasion movement for machining the free bristle ends (5) of the brush (2).

9. The device (1) as claimed in claim 8, wherein at least one of the at least one clamping device (3) or the at least one abrasive sleeve (4) is (a) rotatable about a longitudinal center axis of the brush (2), the at least one abrasive sleeve (4), or the at least one clamping device (3), and (b) movable linearly with respect to the longitudinal center axis of the brush (2), the at least one abrasive sleeve (4), or the at least one clamping device (3).

10. The device (1) as claimed in claim 9, further comprising a rotation drive (7) with which the at least one of the at least one abrasive sleeve (4) or the at least one clamping device (3) is set into rotation, and a linear drive (9) with which at least one of the at least one clamping device (3) or the at least one abrasive sleeve (4) is movable linearly or axially.

11. The device (1) as claimed in claim 7, further comprising a suction device (13) with at least one suction opening (14) which is assigned to at least one of the at least one abrasive sleeve (4) or to the at least one clamping device (3).

12. The device (1) as claimed in claim 7, further comprising a carousel machine (15) which includes a plurality of the clamping devices (3) revolving along a closed path (16), with the clamping devices (3) arranged on a common holding ring (17), said common holding ring being movable about an axis of rotation (19) of the device (1) by a carousel drive (18).

13. The device (1) as claimed in claim 7, wherein there are at least two different abrasive sleeves of the at least one abrasive sleeves (4).

14. The device (1) as claimed in claim 7, further comprising at least one of a cleaning device (20) for machined brushes (2), or a cleaning station (21) for the at least one clamping device (3).

15. The device (1) as claimed in claim 7, wherein the at least one abrasive sleeve (4) has an inner abrasive surface (23) that is at least one of provided or coated with an abrasive material.

16. The device (1) as claimed in claim 7, wherein the at least one abrasive sleeve (4) comprises abrasive block or of an abrasive paper wound to form a sleeve, or is sintered or 3D-printed.

17. The device (1) as claimed in claim 7, wherein the at least one abrasive sleeve (4) has at least one cross-sectional constriction (24) on an inner circumferential wall (25) thereof, and the cross-sectional constriction (24) runs helically or two or more cross-sectional constrictions (24) are arranged or formed at an axial distance from each other in the abrasive sleeve (4).

18. The device (1) as claimed in claim 17, wherein between the at least one cross-sectional constriction (24) and an inner circumferential wall (25) of the abrasive sleeve (4), said inner circumferential wall being adjacent to the cross-sectional constriction (24), at least one oblique surface (26) is formed which connects the at least one cross-sectional constriction (24) and the inner circumferential wall (25) to each other.

19. The device (1) as claimed in claim 7, wherein an inside diameter of the at least one abrasive sleeve (4) is smaller than an outside diameter of a set of bristles (6) of the brush (2) which is to be machined with the device (1).

20. The device (1) as claimed in claim 7, wherein the at least one abrasive sleeve (4) comprises a single-part abrasive sleeve (4), or the at least one abrasive sleeve (4) comprises a multi-part abrasive sleeve (4) including two or more partial sleeves (4*a*).

21. The device (1) as claimed in claim 7, further comprising a funnel plate (27) arranged between the at least one clamping device (3) and the at least one abrasive sleeve (4), the funnel plate (27) has an introducing cone (28) which tapers toward the at least one abrasive sleeve (4), and a longitudinal center axis of the introducing cone (28) is congruent with a longitudinal center axis of the abrasive sleeve (4) arranged therebehind.

22. The device (1) as claimed in claim 7, wherein the at least one abrasive sleeve (4) has at least one inner suction opening (29) which opens into the abrasive sleeve (4).

23. The device (1) as claimed in claim 7, further comprising at least one of an input device (30) or a removal device (31) for at least one of inputting or removing brushes (2).

24. The device (1) as claimed in claim 23, wherein at least one of the input device (30) or the removal device (31) is configured to simultaneously input or remove a plurality of brushes (2) within one working cycle.

25. The device (1) as claimed in claim 23, wherein at least one of the input device (30) is configured to be connected via at least one supply line (59) for brushes (2) to a station clamped upstream of the device (1), or the removal device (31) is configured to be connected via at least one supply line (59) for brushes (2) to a station clamped downstream of the device (1).

26. The device (1) as claimed in claim 7, wherein the clamping device (3) comprises the at least one holder (39) for the at least one stabilizing sleeve (38), wherein the at least one stabilizing sleeve at the distal end (40) thereof facing the set of bristles (6) of the brush (2) in the use position has an outer bevel (41) which forms an encircling supporting surface for bristle filaments (42) of the brush (2), said bristle filaments being arranged proximally in the set of bristles (6).

27. The device (1) as claimed in claim 26, wherein the at least one clamping device (3) comprises at least the holder (39) for the stabilizing sleeve (38), and at least one of an adjusting element (45) or a pressure transmission element (47) connected to the clamping sleeve (43) is arranged in or on the holder (39).

28. The device (1) as claimed in claim 26, comprising a roller machine which has a clamping block (48) which is rotatable about a rotation axis (R) and on which a plurality of the clamping devices (3) are arranged.

29. The device (1) as claimed in claim 26, wherein the at least one clamping device (3) has at least one rapid clamp on the holder (39).

30. The device (1) as claimed in claim 7, wherein the clamping sleeve (43) has at least one slot (43*a*), is arranged within the at least one stabilizing sleeve (38), or has the at least one slot and is arranged within the stabilizing sleeve, and the at least one stabilizing sleeve (38) has, in an interior thereof, a clamping bevel (46) for deforming the clamp, and the clamping bevel (46) is arranged adjacent to the plug-in opening (44) of the stabilizing sleeve (38).

31. The device (1) as claimed in claim 7, further comprising a monitoring device (52) configured to monitor at least one of an inputting, removal, or clamping of the at least one brush (2).

32. The device (1) as claimed in claim 7, further comprising a rapid clamping device (58) for the at least one abrasive sleeve (4).

* * * * *